US005562844A

United States Patent [19]

Bohlender et al.

[11] Patent Number: 5,562,844

[45] Date of Patent: Oct. 8, 1996

[54] PTC HEATER RADIATOR WITH FRAME MEMBERS APPLYING PRESSURE TO HEATERS

[75] Inventors: Franz Bohlender, Kandel/Pfalz; Josef David, Bergzabern, both of Germany

[73] Assignee: David & Baader - DBK-Spezialfabrik elektrischer Apparate und Heizwiderstande GmbH, Kandel/Pfalz, Germany

[21] Appl. No.: 349,457

[22] Filed: Dec. 5, 1994

Related U.S. Application Data

[63] Continuation of Ser. No. 72,539, Jun. 4, 1993, abandoned.

[30] Foreign Application Priority Data

Jun. 23, 1992 [EP] European Pat. Off. ..... 92110544

[51] Int. Cl.[6] ..... F24H 3/04; F24H 9/18

[52] U.S. Cl. ..... 219/540; 219/505; 392/379; 392/360

[58] Field of Search ..... 219/202, 530, 219/540, 504, 505; 392/379, 360, 365

[56] References Cited

U.S. PATENT DOCUMENTS 5,057,672 10/1991 Bohlender et al. ..... 219/540
5,187,349 2/1993 Curhan et al. ..... 219/202
5,239,163 8/1993 Brouwers ..... 219/202
5,256,857 10/1993 Curhan et al. ..... 219/202
5,471,034 11/1995 Kawate et al. ..... 219/505

FOREIGN PATENT DOCUMENTS 443618 2/1991 European Pat. Off. .
9003832 4/1990 Germany .

*Primary Examiner*—John A. Jeffery
*Attorney, Agent, or Firm*—Darby & Darby, P.C.

[57] ABSTRACT

In an electric radiator having a frame in which an arranged heat output elements, which include PTC resistors, and heating elements including fins, which abut on these heat output elements. The heating elements are supported by two oppositely disposed frame bars in such a way that they apply pressure to the heat output elements, said frame bars including rails having a U-shaped cross-section with flat legs extending from a central leg which is provided with longitudinally extending bulging portions separated from the central leg to impart spring properties to said bulging portions which is applied to the heating elements.

18 Claims, 3 Drawing Sheets

PTC HEATER RADIATOR WITH FRAME MEMBERS APPLYING PRESSURE TO HEATERS

This is a continuation of application Ser. No. 08/072,539, filed Jun. 4, 1993, abandoned.

BACKGROUND OF THE INVENTION

The present invention refers to a radiator of the type known from U.S. Pat. No. 5,057,672.

In the case of the known radiator, the first bars of a holding frame consist of an inner strip which is in contact with the fins. A rigid outer rail extends in parallel, spaced relationship with said inner strip, and an undulated sheet-metal strip spring is arranged between said inner strip and said outer rail. The spring rests on said outer rail and presses said inner strip against the locations of reversal of neighboring fins.

This structural design is comparatively complicated. In view of the fact that the individual bars consist of several parts, they are difficult to assemble, and, moreover, the best possible thermal contact is not obtained because, especially in the case of thickness tolerances of the PTCs (positive temperature coefficient), a good surface contact cannot be achieved at some points.

BRIEF DESCRIPTION OF THE INVENTION

The present invention is based on the task of providing a radiator of the above-described type which guarantees a sufficiently strong, large-area pressure of the fins on the elements giving off heat and which has a simple structural design and is easy to assemble.

The invention relates to a new structural design of the first bars of the above-described radiator. Instead of a three-piece arrangement, the present invention realizes a one-piece arrangement for each bar. Accordingly, two production processes can be dispensed with, and the assembly operation will be facilitated. Moreover, even in the case of dimensional tolerances of the PTC (positive temperature coefficient) heating elements, a good surface contact and, consequently, a good heat output is achieved.

The rigidity of the bars can be increased by providing them with an adequate profile, of a nature such that the respective outer legs of the bars are bent inwards. In the case of a different embodiment, the open cross-section of each of the first bars can have arranged therein a rail which has an essentially M-shaped cross-section and the outer legs of which are riveted to or welded to the outer legs of the bar. This rail will impart to the bar a particularly high degree of rigidity, which will resist bending.

BRIEF DESCRIPTION OF THE DRAWINGS

In the following, the present invention will be explained in detail with reference to the embodiments shown in the drawings, in which.

DETAILED DESCRIPTION OF THE INVENTION

Figure 1:
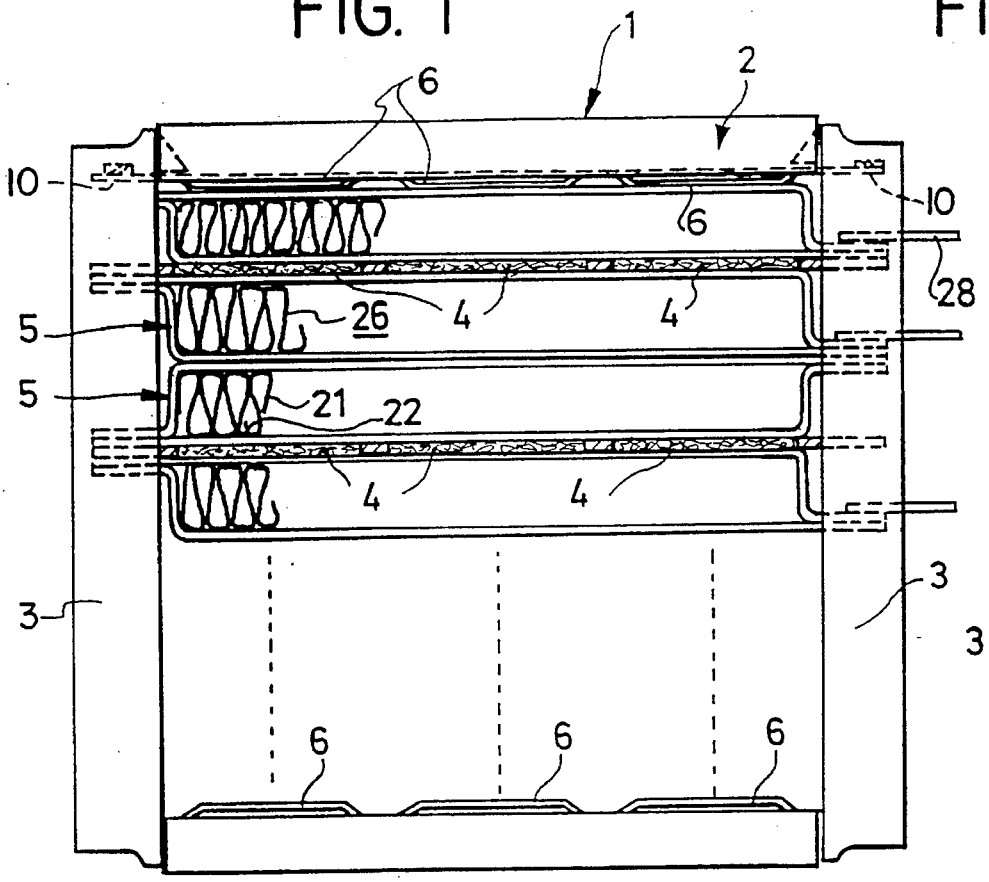
FIG. 1 shows a side view of a radiator according to the present invention, partly cut away.
Figure 2:
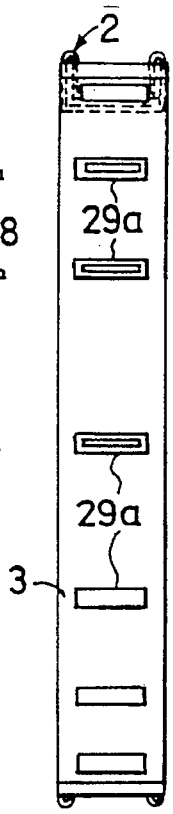
FIG. 2 shows an end view of the radiator according to FIG. 1.
Figure 3:
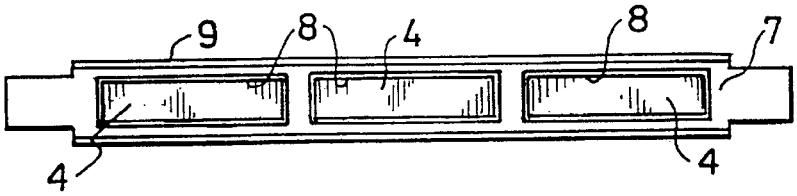
FIG. 3 shows a top view of a plastic frame having PTC elements arranged therein.

The drawing shows a radiator in a side view, and, in order to make clear where the electric heating elements are located, said heating elements are shown in a sectional view. The radiator includes a holding frame 1 having first, longitudinally extending bars 2 and second, transversely extending bars 3. The first and second bars 2 and 3 are interconnected at their ends, and define a plane. Parallel to the first frame bars 2 and perpendicularly to the plane of frame 1, several planes, in which electric heating elements 4 are located, extend parallel to one another. The electric heating elements 4 provide heat to neighboring heat-conducting elements 5, which are later described. The electric heating elements 4, which are preferably PTC elements, and the heat-conducting elements 5 define a multi-layer structure, which is fixed between the two oppositely disposed first bars 2 of the frame 1. The above-mentioned elements are pressed together by force applied by springy bulging portions 6, formed on the first bars 2. The force created by these bulging portions is taken up by the second frame bars 3.

The PTC elements 4 are held in a plastic frame 7 in respective groups of several elements. The plastic frame 7 has a thickness which is slightly thinner than that of the PTC elements 4 and includes windows or openings 8 in which said PTC elements 4 are held. The longitudinal edges of the plastic frame 7 are provided with edges 9 of increased height preventing the heat conducting elements 5 and the plastic frame 7 from being displaced relative to one another.

Figure 4:
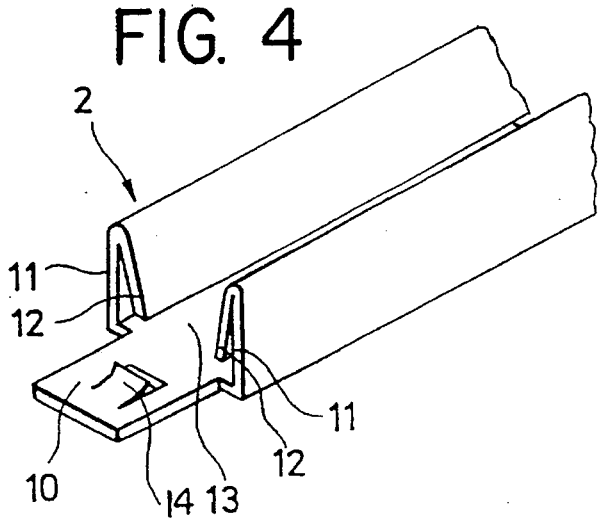
FIG. 4 shows a fragmentary view of a first embodiment of a first bar.

According to FIG. 4, the first, longitudinally extending bars 2 of the frame 1 have an essentially U-shaped rail, which is made of a resilient material, the legs of which are flat and the outer legs 11 being bent inwards. The inwardly bent portions 12 of the outer legs 11 end a short distance above a flat central leg 13. Said inwardly bent portions 12 impart high rigidity to the bar 2. The central leg 13 has an extending lug 10 at each end thereof (in FIG. 4 only one end is shown). A resilient tongue 14 whose free end is directed towards the bar 2 is cut and bent out of said lug 10.

Figure 5:
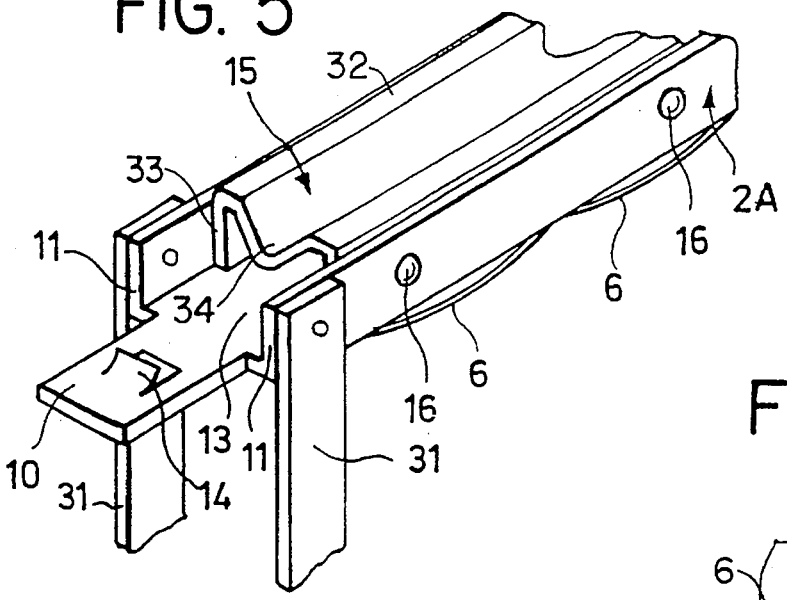
FIG. 5 shows a fragmentary view of a second embodiment of a first bar.

In the case of the alternative according to FIG. 5, the free interior of the bar 2, which has a U-shaped cross-section, has inserted therein a rail 15, which has an M-shaped cross-section. The outer legs of said rails are fastened by riveting or welding to the outer legs 11 of the bar 2 at several points 16. Also this construction guarantees a desired rigidity for the bar 2.

FIG. 5 additionally discloses two sheet-metal strips 31, which are welded to the outer legs 11 of the U-shaped bar 2 in the end section of said U-shaped bar. These sheet-metal strips 31 extend up to the corresponding outer legs of the other bar 2, which is not shown in FIG. 5, and they are welded to said outer legs such that a mechanical pretension of the whole arrangement is obtained so as to take up the spring forces generated by the bulging ports 6. The second bars 3 can then be slid onto the arrangement, which is held together by said sheet-metal strips, in a largely strain-free manner.

Figure 6:
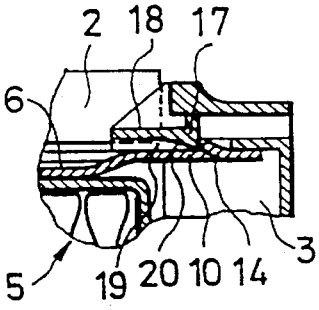
FIG. 6 shows an enlarged sectional view of the upper corner area of FIG. 1 taken along lines 6—6 of FIG. 1.

As can be seen in FIG. 1 and in the enlarged sectional view of FIG. 6, the lug 10 of a first bar 2 is inserted into a cavity in the neighboring second bar 3, and the free end of its tongue 14 is locked in position behind a shoulder 17 formed on a section of said second bar 3 extending over the lug 10. From this section, a projection 18 extends into the free space between the lateral legs of the first bar 2, said projection 18 applying pressure to the central leg 12 of said first bar 2 and pressing, consequently, the bulging portions 6 onto the neighboring heat-conducting element 5. In order to facilitate assembly, the lower surface of the projection 18 is provided with a guide passage for the tongue 14, said guide passage merging with a ramp 20 which leads to the shoulder 17. A leg 2 of the heat conducting element 5 fin is shown attached to the inner surface of element 5 at 19.

Figure 7:
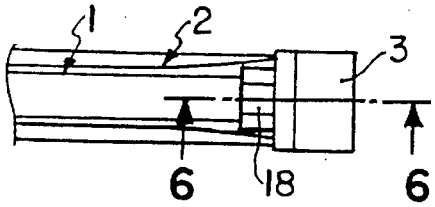
FIG. 7 shows a fragmentary view of the radiator according to FIG. 1 from above.

FIG. 7 discloses the arrangement according to FIGS. 1 and 6 from above in an assembled condition. Said figure shows the projection 18 on the second bar 3, which engages the space between the lateral legs 11 of the first bar 2 thus urging the inner portions 12 slightly sidewards and which applies pressure to the central leg 13.

Figure 8:
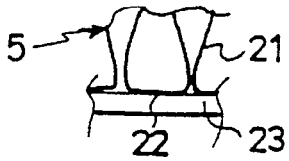
FIG. 8 shows a detail concerning a different embodiment of a strip of fins.

The detail disclosed in FIG. 8 shows that the vertices at the reversing portions 22 of the strip of fins are as flat as possible. In this connection, it may be advantageous when the vertex area is slightly convex so as to guarantee under pressure a close contact of the strip of fins with a neighboring sheet-metal strip 23.

Figure 9:
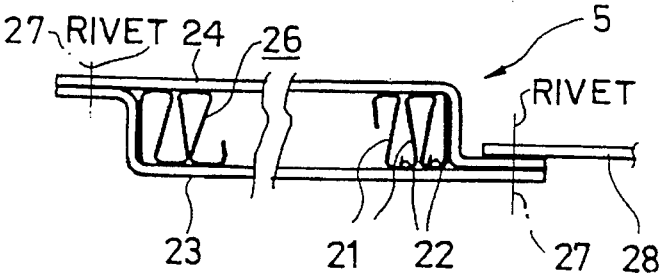
FIG. 9 shows an embodiment of a heat-conducting element.

FIG. 9 shows a preferred embodiment of a heat-conducting element. This heat-conducting element has two sheet-metal strips 23 and 24, each of which is angled twice at one end thereof. The angled ends are arranged point-symmetrically with respect to each other, so that they enclose in a plane-parallel area of the sheet-metal strips 23 and 24 an approximately rectangular space in which a strip of fins 26 is located whose structural design corresponds e.g., to that shown in FIG. 8. The contacting portions of the two sheet-metal strips 23 and 24 are interconnected by rivets or the like, which are here shown symbolically by reference numeral 27. One end has also attached thereto a connection lug 28, which is fastened by means of rivets.

Figure 10A:
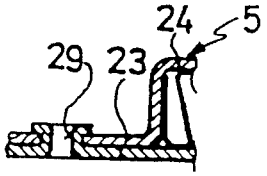
FIGS. 10*a* and 10*b* show details of a heat-conducting means according to FIG. 9.
Figure 10B:
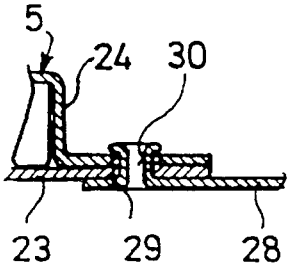

FIG. 10*a* and 10*b* show details of the riveted joint connecting the sheet-metal strips 23 and 24 of the heat-conducting element according to FIG. 9. It can be seen in FIG. 10*a* that a riveting sleeve 29 is formed integrally with one of the sheet-metal strips 23 by means of deep-drawing. The riveting sleeve 29 extends through an adequate hole, which is provided in the other sheet-metal strip 24, and is clamped in position in said hole of said sheet-metal strip 24 by expansion of its free end. A comparable connection of the sheet metal strips 23 and 24 is also provided on the other side, as can be seen in FIG. 10*b* , the contact connection lug 28 being—in a comparable manner—provided with an integrally formed riveting sleeve 30. Riveting sleeve 30 is passed through the riveting sleeve 29 and is flanged at the end thereof to secure the connection lug 28 in position on the heat-conducting element and to establish an electric contact simultaneously.

Figure 11:
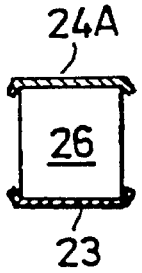
FIG. 11 shows a cross-sectional view of a heat-conducting element similar to FIG. 9.

As is shown, by way of example, in the sectional view of FIG. 11, the sheet-metal strips 23 and 24 can be slightly flanged at their edges to prevent the strip of fins 26 from being displaced to the side.

As can be seen in FIG. 1, the heat-conducting elements 5 directly abut on the electric heating elements 4. Hence, the heat will pass from the electric heating elements 4 through one of the sheet-metal strips 23 and 24 to the neighboring strip of fins 26, which, consequently, take up the heat and give it then off to the ambient air. As can be seen in FIG. 1, two heat-conducting elements 5 of this type can be arranged between two neighboring planes of heating elements. In view of the fact that the heat-conducting elements 5 are in direct contact with the PTC elements 4, they can be used for supplying power to said elements 4, and, for this purpose, the above-mentioned connection lug 28 is provided. From FIG. 1, it is evident that a respective group of heating elements 4 can be supplied with power with the aid of two such heat-conducting elements 5. The connection lugs 28 extend through openings 29*a* in the second bars 30, which are produced of an electrically insulating material, typically a plastic material.

As will be clearly evident from FIG. 9, the heating elements 5 can be combined to form prefabricated units. Therefore, it is only necessary to stack these units with the heating elements 4 held by the plastic frames 7, with one another and with the first bars 1, as can be seen in FIG. 1. The lateral second bars 3 are pushed on from the side, which has the effect that their projections 18 engage the space between the lateral legs 11 of the bars 2. For this purpose, the stack of bars, heating elements and heat-conducting elements can be pressed together so that the projections 18 can be positioned without any difficulties. The pushing together has the effect that the tongues 14 are locked in position behind the shoulders 17 in the bars 3, whereby the arrangement is secured in position. Hence, the assembling operation does not require any soldering, riveting or screwing processes.

Figure 12:
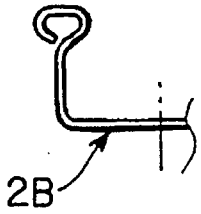
FIG. 12 shows a fragmentary sectional view of an embodiment of a bar rail.
Figure 13:
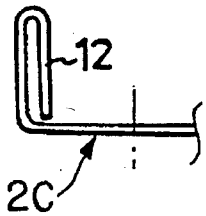
FIG. 13 shows a fragmentary sectional view of an additional embodiment of a bar rail.

Alternative embodiments of the first bars 2 are shown in FIGS. 12 and 13. FIG. 12 shows an embodiment in which the lateral legs of the bars are formed with an upper beadlike edge. FIG. 13 shows an embodiment in which the inner portions 12 of the lateral legs 11 extend approximately parallel to the outer portions of the lateral legs 11.

Figure 14:
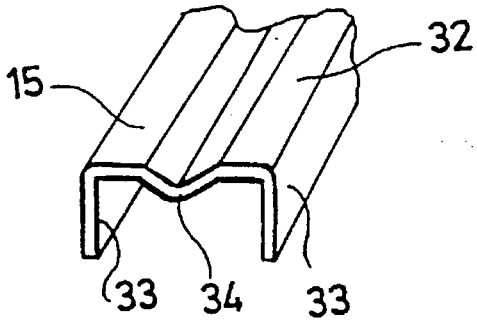
FIG. 14 shows an M-shaped rail similar to that shown in FIG. 5.

FIG. 14 shows an M-shaped rail for insertion between the outer legs of the bars 2 having a U-shaped cross-section like those shown in FIG. 5, the connecting leg 32 between the two outer legs 33 of the rail 15 being flat to a large extent and having a longitudinally extending bear 34 at the center thereof. Also, this rail 15 has to be secured to the associated bar 2 by means of welding spots 16 like those shown in FIG. 5.

Figure 15:
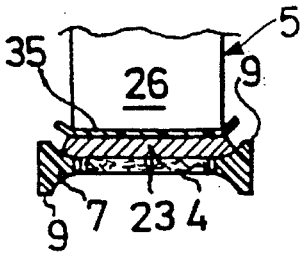
FIG. 15 shows a sectional view of a heat-conducting elements.

FIG. 15 shows an embodiment of a heat-conducting element in the case of which the strip of fins 26 is insulated from the neighboring sheet-metal strips 23 (and 24, respectively) by an insulation foil 35 consisting e.g., of Kapton (TM). The plastic frame 7 holding the electric heating elements 4 has edges which are increased in height and which cover the edges of the sheet-metal strips 23 at least largely to such an extent that they provide protection against contact so that the radiator equipped in this way can be touched with the hands without touching live parts.

Figure 16:
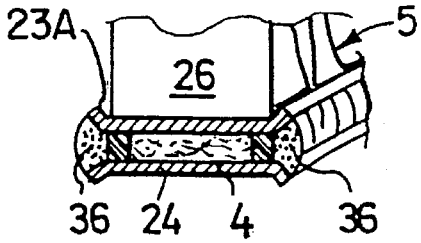
FIG. 16 shows a sectional view of an embodiment of a heat-conducting element including a casting compound.

FIG. 16 shows an embodiment of the present invention in which the space between two neighboring sheet-metal strips 23 and 24 is filled by a casting compound 36 from outside, the electric heating elements being thus protected against environmental influences, especially against water splashes.

In the case of an additional modification possibility, the sheet-metal strips 23 and 24 for holding the strips of fins 26 are dispensed with. These strips of fins 26 will then directly abut on the bulging portions 6 and, possibly, they will abut on one another. In this case, the contacting of the electric heating elements may be effected via separate sheet-metal strips arranged between the strips of fins and the heating elements and provided with connection lugs, which extend to the outside and which are comparable with the connection lugs 28.

We claim:

1. A radiator comprising:

a holding frame having interconnected pairs of each of first bars extending in a first direction and second bars extending generally transverse to said first bars a plurality of elongate electric heating elements extending between said second bars generally parallel to said first bars arranged in stacked planes extending generally parallel to said first bars and;

a plurality of heat-conducting elements arranged in parallel rows each said heat conducting element located between adjacent heating elements, each of said heat-conducting elements including at least one sheet-metal strip of fins extending substantially in a zigzag shape and including substantially straight portions between upper and lower reversing portions, at least one row of reversing portions located adjacent a heating element plane and receiving heat from it, at least one of said first bars including means for applying a mechanical bias pressure between said at least one first bar and the heat-conduction elements to effect transfer of heat from a heating element to said at least one row of reversing portions of a heat conducting element, said mechanical pressure applying means including an elongated rail of resilient material of essentially U-shaped cross-section with side legs depending from a central leg having in the central area of its cross-section a plurality of elongated bulging portions along its length which project from said U-shaped cross-section central leg toward said heat conducting elements.

2. A radiator according to claim 1, wherein the bulging portions project beyond the plane defined by the outer surface of the central leg by a distance corresponding substantially twice the thickness of the material of said central leg.

3. A radiator according to claim 1 wherein the bulging portions have a length corresponding approximately to the length of the heating elements which have pressure applied thereto by said bulging portions.

4. A radiator according to claim 1, wherein the lateral legs of the first bars are bent inwards and downwards at their upper ends.

5. A radiator according to claim 4, wherein the inwardly directed portions of the lateral legs end at a distance above the central leg.

6. A radiator according to claim 4, wherein the free edges of the inwardly directed portions of the lateral legs are located above the cut lines of the bulging portions.

7. A radiator according to claim 1, further comprising a rail having an approximately M-shaped cross-section arranged in the free space between the legs of each of said first bars the outer legs of said rail fastened to the lateral legs of the associated bar.

8. A radiator according to claim 1, wherein the rails defining said first bars have at each of their two ends an extension of the central leg in the form of a flat leg extending tongue whose free end is directed towards the center of the bar cut and bent out, said tongue projecting in the direction in which the lateral legs extend above the central leg of the rail, and the second bars have in each of their two end sections shoulders which extend over the lugs and which are locked in position behind the tongues, each of said shoulders being provided with a projection directed towards the center of said first bars and which rests on the central leg and supports said central leg against the resilient force created by said bulging portions.

9. A radiator according to claim 1, wherein each of the heat-conducting elements comprises two plane-parallel spaced sheet-metal strips arranged point-symmetrically with respect to each other and angled twice at one end thereof to define the mutual distance between the plane-parallel section which have the strip of fins arranged between them.

10. A radiator according to claim 9, wherein in the plane-parallel area, the edges of the sheet-metal strips are flanged towards the strip of fins to protect said strip of fins against lateral displacement between the plane-parallel sections of said sheet-metal strips.

11. A radiator according to claim 9, wherein the strip of fins of each heat conducting element is insulated from the sheet-metal strips by an electrically insulating foil having thermal conductivity.

12. A radiator according to claim 1 wherein the heating elements are of the positive temperature coefficient type held in a frame with cut-out portions for receiving therein said heating elements, which are held in said frame, the thickness of said frame being smaller than that of said heating elements.

13. A radiator according to claim 12, wherein the longitudinal edges of the frame are provided with an edge of increased height to protect the heat conducting elements against lateral displacement.

14. A radiator according to claim 13, wherein the edges of the frame are increased in height to an extent that the sheet-metal strips are protected against manual contact.

15. A radiator according to claim 12, wherein the heating elements are protected against environmental influences by a casting compound.

16. A radiator according to claim 1, wherein portions of the sheet metal strip of fins each is essentially flat and has two adjacent reversing portions that laterally contact one another.

17. A radiator according to claim 1, wherein the lateral legs of the first bars are bent in a beadlike manner at their edge followed by an inner portion.

18. A radiator according to claim 17, wherein, at their outer ends, the first two bars are held together by sheet-metal strips for taking up the forces created by said bulging portions.

* * * * *

UNITED STATES PATENT AND TRADEMARK OFFICE

CERTIFICATE OF CORRECTION

PATENT NO. : 5,562,844

DATED : October 8, 1996

INVENTOR(S) : Franz BOHLENDER and Josef DAVID

It is certified that error appears in the above-indentified patent and that said Letters Patent is hereby corrected as shown below:

Title page, [30], Foreign Application Priority Data, change "92110544" to --92110544.1--.

Signed and Sealed this

Sixth Day of May, 1997

Bruce Lehman

*Attest:*

BRUCE LEHMAN

*Attesting Officer*

*Commissioner of Patents and Trademarks*